US008448365B2

(12) United States Patent
Mead et al.

(10) Patent No.: US 8,448,365 B2
(45) Date of Patent: May 28, 2013

(54) COCKING SYSTEM FOR DART LAUNCHER

(75) Inventors: Raymond Aaron Mead, Pawtucket, RI (US); Brian C. Jablonski, Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 13/351,045

(22) Filed: Jan. 16, 2012

(65) Prior Publication Data

US 2013/0067787 A1 Mar. 21, 2013

Related U.S. Application Data

(63) Continuation-in-part of application No. 29/401,859, filed on Sep. 16, 2011.

(51) Int. Cl.
*F41A 33/00* (2006.01)

(52) U.S. Cl.
USPC ..... 42/54; 89/1.4; 89/1.42; 42/71.02

(58) Field of Classification Search
USPC ..... 89/1.4, 1.42; 42/54
See application file for complete search history.

(56) References Cited

U.S. PATENT DOCUMENTS 822,646 A * 6/1906 Bourne ..... 42/71.02
961,511 A 6/1910 Marble
966,165 A * 8/1910 Cobb ..... 42/71.02
1,331,155 A 2/1920 Johnson
1,374,757 A 4/1921 Napier
1,410,639 A * 3/1922 Aronson ..... 446/23
D142,016 S * 8/1945 Birk ..... D22/104
2,530,658 A * 11/1950 Gricar ..... 124/27
D170,091 S * 7/1953 Maywald ..... D21/574
2,908,987 A 10/1959 Allyn
3,472,218 A * 10/1969 La Mers ..... 124/67
3,758,978 A * 9/1973 Theodore ..... 42/71.02
3,968,783 A 7/1976 Pfotenhauer
4,139,959 A 2/1979 Howard et al.
4,170,215 A 10/1979 Kettlestrings
4,248,202 A 2/1981 Jaworski et al.
4,467,698 A * 8/1984 Perrine ..... 89/190
4,558,533 A * 12/1985 Seliga ..... 42/71.02
4,586,282 A * 5/1986 Sniezak ..... 42/71.02
4,659,320 A 4/1987 Rich et al.
4,833,812 A * 5/1989 Farrar ..... 42/71.02
5,239,766 A * 8/1993 Wang ..... 42/54
5,471,967 A 12/1995 Matsuzaki et al.
5,529,050 A 6/1996 D'Andrade
5,611,322 A 3/1997 Matsuzaki et al.
5,621,997 A * 4/1997 Pearce ..... 42/71.02
5,662,244 A * 9/1997 Liu et al. ..... 222/79
5,815,972 A * 10/1998 Anderson ..... 42/65

(Continued)

OTHER PUBLICATIONS

Hasbro, NERF Nite Finder Instruction Manual, 2003, pp. 1-3.*

*Primary Examiner* — Daniel J Troy
*Assistant Examiner* — Derrick Morgan
(74) *Attorney, Agent, or Firm* — Perry Hoffman

(57) ABSTRACT

A cocking system for a toy gun apparatus wherein a gun housing includes a grip portion with an outward extending tab and a cocking handle connected to the gun housing. The handle is structured to receive the tab of another gun apparatus being held in a user's other hand to allow play where a user is able to hold two gun apparatus, one in each hand, and fire each and then cock each gun apparatus without releasing either gun apparatus.

14 Claims, 5 Drawing Sheets

U.S. PATENT DOCUMENTS

| | | | | |
|---|---|---|---|---|
| 5,881,928 | A * | 3/1999 | Register et al. | 222/340 |
| 5,956,878 | A | 9/1999 | Yang | |
| 5,996,564 | A | 12/1999 | Kotowski | |
| 6,224,457 | B1 | 5/2001 | Wu | |
| 6,250,294 | B1 | 6/2001 | Lim | |
| 6,598,329 | B1 | 7/2003 | Alexander | |
| 6,726,072 | B2 * | 4/2004 | Rugh | 224/269 |
| 6,733,356 | B2 | 5/2004 | Lee | |
| 7,287,526 | B1 | 10/2007 | Bligh et al. | |
| 7,418,797 | B1 | 9/2008 | Crose | |
| 7,437,847 | B1 | 10/2008 | Mabry | |
| 7,552,557 | B1 | 6/2009 | Mabry | |
| 7,673,624 | B2 | 3/2010 | Rosella, Jr. | |
| 8,186,337 | B2 * | 5/2012 | Nadel | 124/63 |
| 2006/0180134 | A1 | 8/2006 | Illuzzi | |
| 2006/0242880 | A1 | 11/2006 | Griffin | |
| 2009/0064979 | A1 * | 3/2009 | Andrews | 124/65 |
| 2009/0229158 | A1 | 9/2009 | Victor | |
| 2009/0249672 | A1 | 10/2009 | Zedrosser | |
| 2012/0073554 | A1 * | 3/2012 | Victor et al. | 124/16 |
| 2012/0080018 | A1 * | 4/2012 | Victor | 124/16 |
| 2012/0279105 | A1 * | 11/2012 | Emde et al. | 42/1.08 |

* cited by examiner

COCKING SYSTEM FOR DART LAUNCHER

CROSS-REFERENCE TO RELATED APPLICATION

This application is a continuation-in-part of U.S. application Ser. No. 29/401,859, filed on Sep. 16, 2011.

FIELD OF THE INVENTION

The present invention relates generally to a cocking system for a gun, and, more particularly, to a simple and effective cocking system for a gun apparatus when a user is holding a gun apparatus in each hand.

BACKGROUND OF THE INVENTION

Toys and other devices that discharge projectiles by release of a compressed or stretched spring are well known and are disclosed in several existing patents. By way of example, U.S. Pat. No. 2,530,658 for a "Toy Spring Pistol" issued in 1950 to Gricar purports to disclose a spring operated pistol having a plunger with a ring shaped end portion for a user to grasp. When a user pulls on the ring to retract the plunger, the spring compresses and cocks the pistol. Once the plunger is retracted, teeth indentations on the plunger are engaged by a pin mounted to the pistol to hold the retracted plunger until the plunger is lifted off the pin when the user pivots a trigger. Once the plunger is lifted, the spring is released to cause a projectile to be discharged. Two patents issued to Bligh, Mead and Brown, U.S. Pat. No. 7,287,526, granted in 2007, and U.S. Pat. No. 7,481,209, granted in 2009, both entitled "Toy Projectile Launcher With Slidable Outer Cylinder and Stationary Inner Compression Member," purporting to describe toy air guns for firing darts. Each air gun includes a slide for a user to grab and retract to cock the launcher. At the rear of the slide is a hammer spur with an opening. In one other embodiment the air gun includes a "shoulder" around the slide and the gun is carried in a holster. Abutment between the shoulder of the air gun and an edge of the holster allows a user to cock the air gun while still in the holster by pushing downward on a grip of the air gun.

These patents and the devices disclosed are of some interest, however, they do not teach a system for using one gun to cock a second gun so as to enable a user to use a gun in each hand, simultaneously.

SUMMARY OF THE INVENTION

In accordance with the present invention, an advantageous method and system are described in the form of a gun apparatus embodiment that uses a cocking handle to compress or stretch a spring that upon operation of a trigger, causes a projectile to be discharged. The gun apparatus includes an extending tab for engaging the cocking handle of a second gun apparatus so that a user is enabled to cock one gun apparatus using a second gun apparatus while holding the two gun apparatus, one held in each hand, without setting one of the gun apparatus down. The cocking system is simple, easily operated, structurally robust, compact and relatively inexpensive.

Briefly summarized, the invention relates to a gun cocking system for a gun apparatus including a gun housing having an extending tab structured to engage another gun apparatus, and a cocking handle connected to the gun housing for receiving a tab from another gun apparatus, the tab from the other gun apparatus to enable a user of the first mentioned gun apparatus to move the cocking handle from a forward position to a rearward position.

The invention also relates to a method for making a gun cocking system for a gun apparatus including the steps of forming a gun housing with an outwardly extending tab, forming a cocking handle, the cocking handle structured to receive a tab from another gun housing, and mounting the cocking handle to the gun housing to move between a forward position and a rearward position, a user being able to employ the tab from the other gun housing to move the cocking handle from the forward position to the rearward position.

BRIEF DESCRIPTION OF THE DRAWINGS

For the purpose of facilitating an understanding of the invention, the accompanying drawings and detailed description illustrate an embodiment thereof, from which the structures, construction and operation, processes, and many related advantages of the embodiment may be readily understood and appreciated.

DESCRIPTION OF THE EMBODIMENTS

The following description is provided to enable those skilled in the art to make and use the described embodiment set forth. Various modifications, equivalents, variations, and alternatives, however, will remain readily apparent to those skilled in the art. Any and all such modifications, variations, equivalents, and alternatives are intended to fall within the spirit and scope of the present invention defined by the below listed claims.

Figure 1:
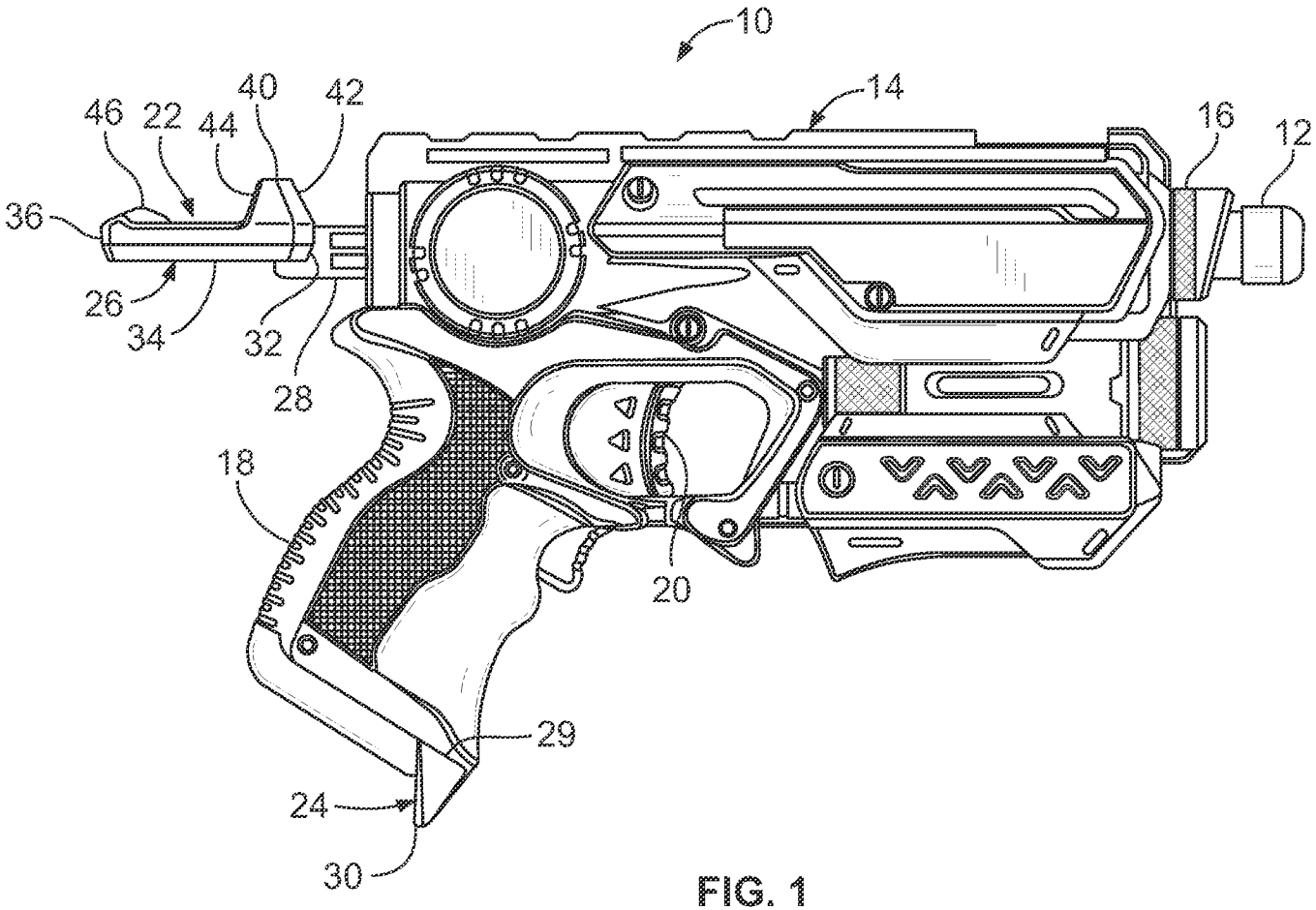
FIG. 1 is a side elevation view of a toy gun apparatus having a cocking system including a tab and a cocking handle described herein below.
Figure 2:
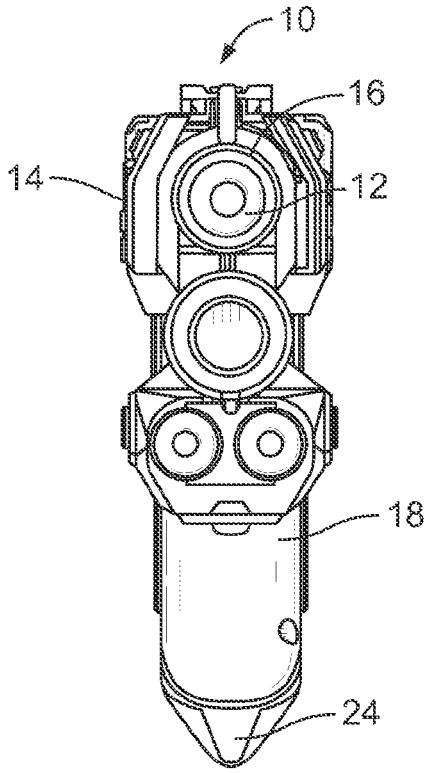
FIG. 2 is a front elevation view of the toy gun apparatus illustrated in FIG. 1.
Figure 3:
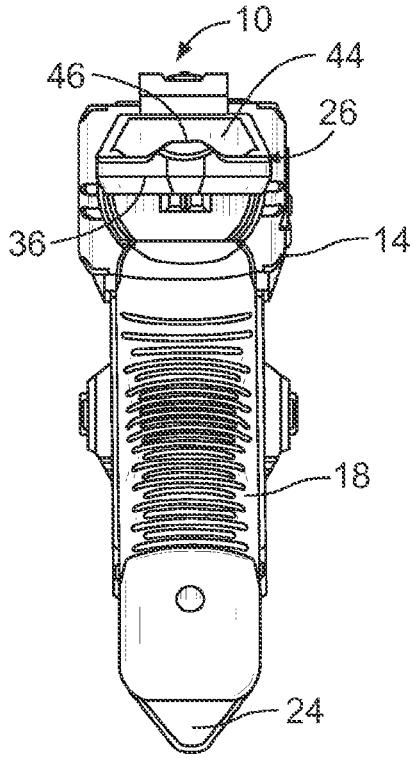
FIG. 3 is a rear elevation view of the toy gun apparatus illustrated in FIGS. 1 and 2.
Figure 4:
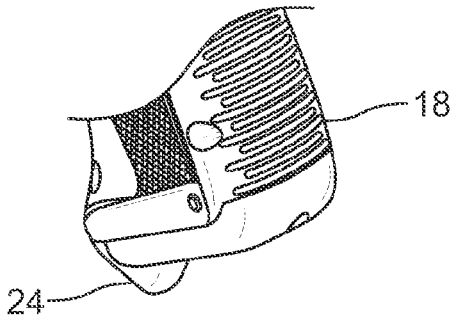
FIG. 4 is a partial rear isometric view of a grip portion of the toy gun apparatus illustrated in FIGS. 1-3, showing the tab.

Referring now to FIG. 1, there is shown an embodiment of a toy gun apparatus 10 for discharging projectiles, such as a dart 12 made of NERF™ brand foam, a solid, spongy cellular material. The toy gun apparatus 10 includes a housing 14 having a forward-located barrel portion 16, a rearward-located grip portion 18 and a trigger 20. The toy gun apparatus also includes a cocking system that includes a cocking handle 22 mounted to and extending from the rear of the housing, and a downward extending tab 24 connected to the forward end of the grip portion 18.

The cocking handle 22 includes a tab engaging handle 26 and a rod 28. The rod 28 extends into the housing 14 and is connected to a spring (not shown) internal of the housing. Cocking the gun apparatus 10 is well known. A user manually moves the handle 26 rearward to compress the spring. This action cocks the gun apparatus. The spring is held in the compressed position until the user squeezes the trigger 20 causing the spring to be released. The energy released by the spring provides the motive force for discharging a dart. As shown, the handle 26 and the rod 28 may be integral, such as by molding the handle and rod as a single structure. In the alternative, the spring may be stretched instead of compressed, a piston movable in a cylinder may be mounted in the housing 14 forming an air gun, and/or the handle may be located to the side, the top, or the bottom of a gun housing with appropriate linkage connected to the spring. The housing may be made of a suitable synthetic resin well known by those skilled in the art and have a fanciful design as shown, simulate a real weapon, or carry a motif from popular entertainment, such as "Star Wars." Other types of projectiles besides foam darts may be used, such as BBs, balls or pellets, after appropriate modification of the internal mechanisms of the gun apparatus. Also in the alternative, the gun apparatus may be made of metal or a combination of metal and plastic.

Referring now to FIGS. 1-4, the tab 24 is connected to or integral with the lower portion of the grip portion 18. The tab 24 has a somewhat tetrahedron shape with a base 29 connected to the grip portion 18, such as by being molded with the grip portion, and an opposite vertex 30 at an extended end portion. The narrowing of the tab 24 as the tab extends away from the grip portion will facilitate engagement of the tab with a handle of another gun apparatus as will be explained in more detail below. The tab 24 may be made of plastic or metal or any other suitable material. In the alternative, the tab may extend from one of the sides or upper portion of the housing, and other shapes besides that shown may be used for structural, aesthetic and/or ergonomic reasons, all of which is well known to those skilled in toy gun design. For example, the tab may narrow to a rounded extended end portion like a finger, or to a rectangular configuration.

Figure 7:
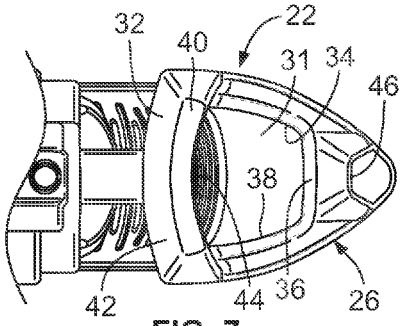
FIG. 7 is a partial top plan view of the cocking handle shown in FIGS. 1, 3, 5 and 6.
Figure 8:
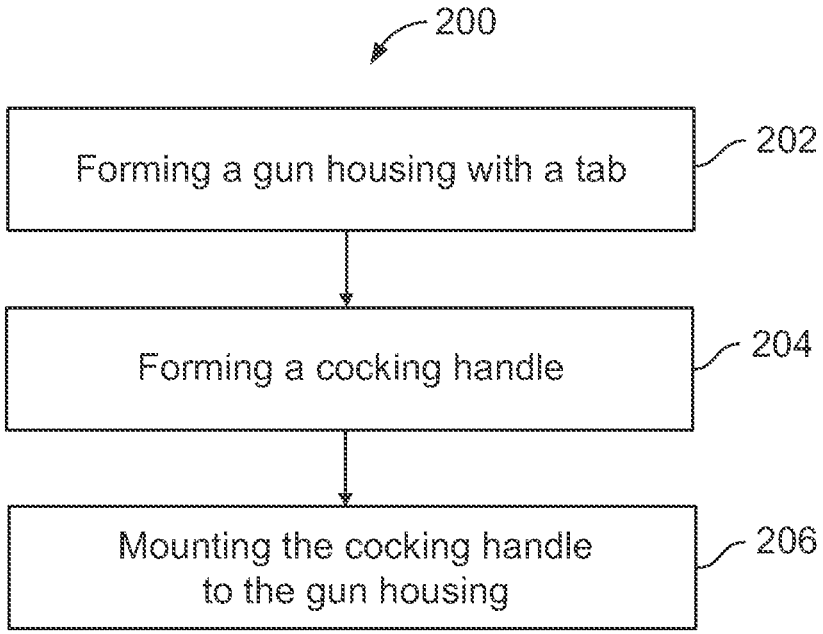
FIG. 8 is a flow diagram for a method of making a toy gun apparatus including a tab and a cocking handle.

Referring now to FIGS. 1 and 7, the handle 26 of the gun apparatus 10 is shown in more detail. The handle 26 is generally ring-like with a somewhat quadrilateral shaped central opening 31, the opening being bordered with four curved arms 32, 34, 36, 38. The forward arm 32 includes an upper wall 40 with slanted and curved front and rear surfaces 42, 44, and the rearward arm 36 has an upper bump or two-sided ramp 46. The particular structure described is provided to facilitate guidance and engagement with the tab 24, as well as to have an aesthetic appeal. It is noted that the handle 26 also has a structure that is easy and convenient to grip with a user's fingers, if so desired. In the alternative, other shapes may be used for the handle 26. The opening may be circular, oval, square, rectangular, trapezoidal or any other convenient geometric shape. There may be an upper wall around the entire opening or none at all. The handle may take the form of a carabiner clip, an oblong ring with one spring-hinged side to enable the tab to enter the central opening from the side of the handle instead of from above. The handle may also include oppositely disposed arms to enable easy finger manipulation by a user, or there may be no opening but only a central recess to receive the tab. The barrel portion 16 may include a single discharge port, as shown, or may include multiple discharge ports on a fixed or rotatable assembly. With a rotatable assembly, after ejection of a dart, the barrel assembly may rotate and, when a discharge port with a dart is moved to the discharge position, the gun apparatus may be "fired" again after being cocked.

It is noted that throughout this description, words such as "forward", "rearward", "upward", "downward", "upper", and "lower", as well as like terms, refer to portions or elements of the gun apparatus as they are viewed in the drawings relative to other portions or in relationship to the positions of the apparatus as it will typically be held and moved during play when operated by a user, or to movements of elements based on the configurations illustrated.

Figure 5:
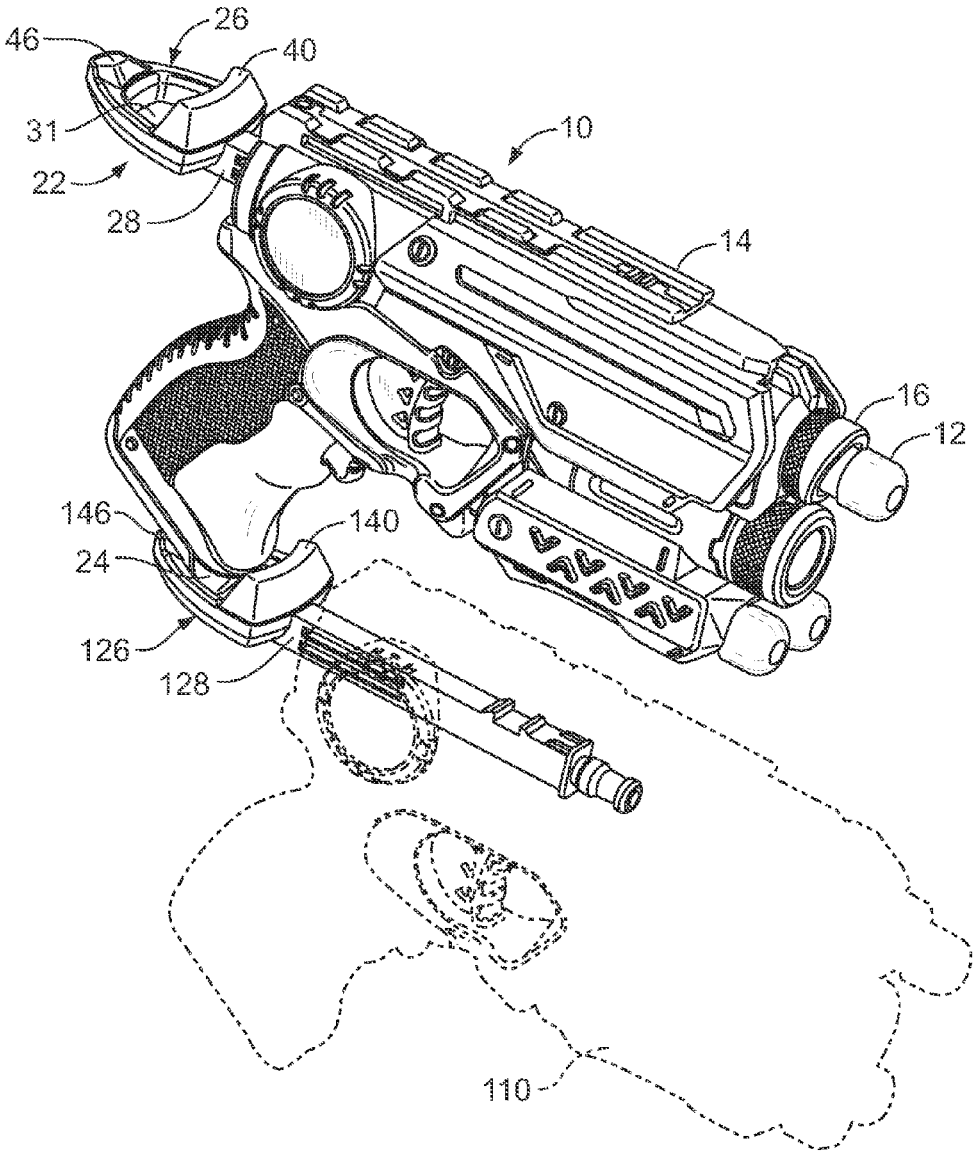
FIG. 5 is an isometric view of the gun apparatus shown in FIGS. 1-4, illustrating the tab of the gun apparatus in engagement with a cocking handle (in solid lines) of another gun apparatus (in phantom lines) prior to cocking the other gun apparatus.
Figure 6:
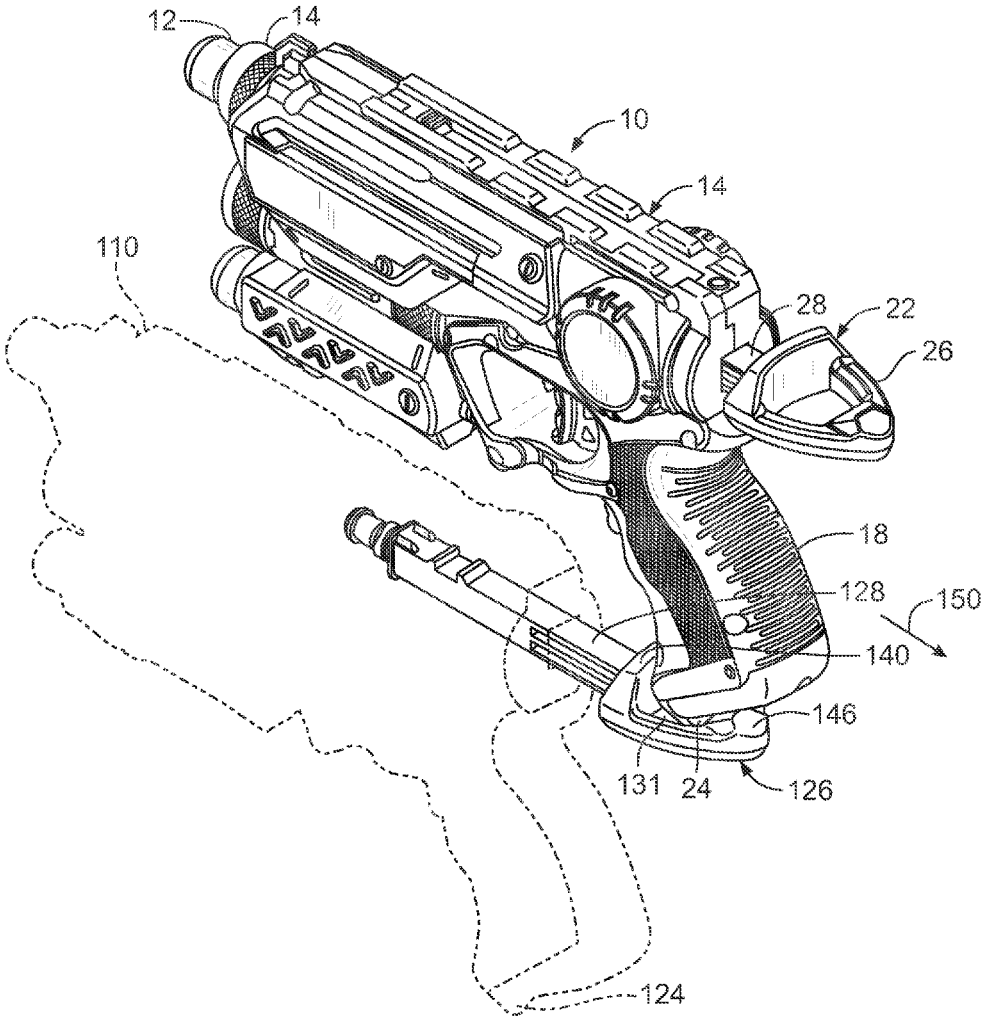
FIG. 6 is a rear isometric view of the two gun apparatus illustrated in FIG. 5, illustrating the first mentioned gun apparatus cocking the other gun apparatus by moving the cocking handle of the other gun apparatus with the tab of the first mentioned gun apparatus to a rearward position.

Referring now to FIGS. 5 and 6, in operation, a user having two gun apparatus 10, 110, one gun apparatus in each hand, may easily and quickly cock each gun apparatus without having to set one of the gun apparatus down, a major advantage of the invention herein. The user merely raises one gun apparatus, such as the gun apparatus 10, to an upper position above the other gun apparatus, such as the gun apparatus 110, and inserts the tab 24 of the one gun apparatus 10 into the opening 131 of the handle 126 of the other gun apparatus 110, as illustrated in FIGS. 5 and 6, between a two sided ramp 146 and an upper wall 140, the handle 126 being connected to a rod 128 of the gun apparatus 110. The ramp 146, the wall 140, the handle 126 and the rod 128 are identical to the ramp 46, the wall 40, the handle 26 and the rod 28 of the gun apparatus 10. While the two gun apparatus are shown in a vertical alignment in FIG. 5, one gun apparatus above the other, both gun apparatus may be slanted or even turned almost horizontal by the user to offer him/her a better view of the engagement process of the tab 24 and the handle 126 of the two gun apparatus. Once the tab and handle are engaged, the user is able to pull back the one, higher, gun apparatus 10, as illustrated in FIG. 6, and symbolized by the arrow 150, to cock the other, lower, gun apparatus 110. Hence, the cocking handle of the lower gun apparatus is movable from a first forward position shown in FIG. 5, to a second rearward position shown in FIG. 6. Thereafter, the tab and handle of the two gun apparatus may be separated and the cocked gun used to discharge a dart. And/or, the user may reverse the positions of the two gun apparatus and cock the first gun apparatus 10, now in the lower position, with the tab 124 of the second gun apparatus 110, now in the higher position.

The toy gun apparatus may include, in the alternative, a projectile magazine, a cartridge, a cassette or a canister loaded with multiple projectiles to load the projectiles, sequentially, into a firing or discharge position.

The gun apparatus disclosed in detail above provides for easy cocking of two gun apparatus in quick succession in an easy, efficient and safe manner, and yet each gun apparatus has a robust, but relatively simple structure, that may be produced at a reasonable cost.

The present invention also includes a method 200 for making the gun cocking system having the steps of forming a gun housing with an outwardly extending tab 202, forming a cocking handle 204, the cocking handle structured to receive a tab from another gun housing, and mounting the cocking handle to the gun housing 206 to move between a forward position and a rearward position, a user being able to employ the tab from the other gun housing to move the cocking handle from the forward position to the rearward position.

From the foregoing, it can be seen that there has been provided features for improved gun apparatus and a disclosure for the method of the making the gun apparatus. While a particular embodiment of the gun apparatus has been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A gun cocking system for a gun apparatus comprising:

a gun housing of a first gun apparatus having a tab extending downward from a grip portion of the first gun apparatus, the tab narrowing as the tab extends away from the grip portion in both the front and side elevation views, and being structured to engage a second gun apparatus alike in structure to the first gun apparatus; and a cocking handle connected to the gun housing for receiving a tab from the second gun apparatus, the tab from the second gun apparatus enables a user to move the cocking handle of the first gun apparatus from a forward position to a rearward position, wherein the cocking handle has a horizontally extending opening bordered by four curved arms forming a four sided structure for receiving the tab from the second gun housing.

2. The gun cocking system of claim 1, wherein:

each of the first and second gun apparatus having a tab extending downward from a grip portion.

3. The gun cocking system of claim 1, wherein:

the cocking handle includes a forward wall formed on a forward arm of a four arm handle structure, the wall having slanted and curved front and rear surfaces.

4. The gun cocking system of claim 1, wherein:

the cocking handle includes a rearward bump formed on a rearward arm of a four arm handle structure, the bump having forward and rearward ramps.

5. The gun cocking system of claim 2, wherein:

the cocking handle on each of the first and second gun apparatus includes a forward wall formed on a forward arm of a four arm handle structure, the wall having slanted and curved front and rear surfaces, and a rearward bump formed on a rearward arm of the four arm structure, the bump having forward and rearward ramps.

6. The gun cocking system of claim 5, wherein:

the extending tab includes a narrow extended end portion in both front and side elevation views.

7. The gun cocking system of claim 6, wherein:

the cocking handle on each of the first and second gun apparatus has an opening bordered by four curved arms.

8. A gun cocking system for a gun apparatus comprising:

a gun housing having a grip portion wherein a first tab extends downward from the grip portion, the first tab narrowing away from the grip portion in both the front and side elevation views; and a cocking handle connected to the gun housing for receiving a second tab alike in structure to the first tab, configured to move the cocking handle from a forward position to a rearward cocking position;

wherein the cocking handle includes a central opening bordered by four curved arms for receiving the second tab.

9. The gun cocking system of claim 8, wherein:

the cocking handle includes a forward wall on a forward arm of the four curved arms, the wall having slanted and curved front and rear surfaces and a rearward bump formed on a rearward arm of the four curved arms, the bump having forward and rearward ramps.

10. The gun cocking system of claim 8, wherein:

the cocking handle includes a central opening bordered by four curved arms for receiving the tab from the other gun apparatus.

11. The gun cocking system of claim 10, wherein:

the cocking handle includes a forward wall on a forward arm of the four curved arms, the wall having slanted and curved front and rear surfaces and a rearward bump formed on a rearward arm of the four curved arms, the bump having forward and rearward ramps.

12. A method for making a gun cocking system for multiple a gun apparatus comprising the steps of:

forming multiple gun housings, each housing having a tab extending downward from a grip portion, the tab narrowing as the tab extends away from the grip portion in both front and side elevation views, and being structured to engage another gun apparatus;

forming a cocking handle for each of the multiple gun housings, each of the cocking handles structured to receive a tab from another gun housing, each of the cocking handles having a horizontally extending opening bordered by four curved arms forming a four sided structure; and mounting each of the cocking handles to a gun housing to move between a forward position and a rearward position, a user being able to employ the tab from another gun housing to move the cocking handle from the forward position to the rearward position.

13. The method of claim 12, wherein:

the step of forming a cocking handle includes forming a forward wall on a forward arm of the four sided structure, the wall having slanted and curved front and rear surfaces and forming a rearward bump on a rearward arm of the four sided structure.

14. The method of claim 13, wherein:

the step of forming a cocking handle includes forming the bump with forward and rearward ramps.

* * * * *